US009934791B1

(12) United States Patent
Su

(10) Patent No.: US 9,934,791 B1
(45) **Date of Patent: *Apr. 3, 2018**

(54) NOISE SUPRESSOR

(71) Applicant: Huan-Yu Su, San Clemente, CA (US)

(72) Inventor: Huan-Yu Su, San Clemente, CA (US)

(73) Assignee: QOSOUND, INC., San Clemente, CA (US)

( * ) Notice: Subject to any disclaimer, the term of this patent is extended or adjusted under 35 U.S.C. 154(b) by 16 days.

This patent is subject to a terminal disclaimer.

(21) Appl. No.: 15/277,969

(22) Filed: Sep. 27, 2016

Related U.S. Application Data

(63) Continuation of application No. 14/629,819, filed on Feb. 24, 2015, now Pat. No. 9,484,043.

(60) Provisional application No. 61/948,309, filed on Mar. 5, 2014.

(51) Int. Cl.
*G10L 21/0224* (2013.01)
*G10L 21/034* (2013.01)

(52) U.S. Cl.
CPC ..... *G10L 21/0224* (2013.01); *G10L 21/034* (2013.01)

(58) Field of Classification Search
CPC . G10L 21/02; G10L 21/0208; G10L 21/0216; G10L 21/0224; G10L 21/034
USPC ..... 704/211, 226–228; 381/94.1
See application file for complete search history.

(56) References Cited

U.S. PATENT DOCUMENTS

| | | | | |
|---|---|---|---|---|
| 5,107,539 | A * | 4/1992 | Kato | H03G 3/32 381/108 |
| 6,674,865 | B1 * | 1/2004 | Venkatesh | H04M 9/082 381/107 |
| 8,150,045 | B2 * | 4/2012 | Thuy | G10L 21/0208 381/57 |
| 8,320,974 | B2 * | 11/2012 | Nicholson | H04M 1/605 381/71.1 |
| 8,811,602 | B2 * | 8/2014 | Khanduri | H04M 9/082 379/406.06 |
| 2010/0278353 | A1 * | 11/2010 | Taenzer | H04R 1/1083 381/73.1 |
| 2011/0194699 | A1 * | 8/2011 | Baker | H04B 1/1661 381/3 |

* cited by examiner

*Primary Examiner* — James Wozniak
(74) *Attorney, Agent, or Firm* — Keith Kind

(57) ABSTRACT

Provided is a method, non-transitory computer program product and system for an improved noise suppression technique for speech enhancement. It operates on speech signals from a single source such as either the output from a single microphone or the reconstructed speech signal at the receiving end of a communication application. The system performs background noise monitoring of an in-coming speech signal and determines its level, and performs a time domain gain calculation. The noise suppressed output signal is the gain shaped original speech signal.

3 Claims, 8 Drawing Sheets

NOISE SUPRESSOR

CROSS REFERENCE TO OTHER APPLICATIONS

The present application is a Continuation of U.S. application Ser. No. 14/629,819 filed on Feb. 24, 2015, now U.S. Pat. No. 9,484,043. The present application is related to co-pending U.S. patent application Ser. No. 13/975,344 entitled "METHOD FOR ADAPTIVE AUDIO SIGNAL SHAPING FOR IMPROVED PLAYBACK IN A NOISY ENVIRONMENT" filed on Aug. 25, 2013 by HUAN-YU SU, et al., co-pending U.S. patent application Ser. No. 14/193,606 entitled "IMPROVED ERROR CONCEALMENT FOR SPEECH DECODER" filed on Feb. 28, 2014 by HUAN-YU SU, co-pending U.S. patent application Ser. No. 14/534,531 entitled "ADAPTIVE DELAY FOR ENHANCED SPEECH PROCESSING" filed on Nov. 6, 2014 by HUAN-YU SU, co-pending U.S. patent application Ser. No. 14/534,472 entitled "ADAPTIVE SIDETONE TO ENHANCE TELEPHONIC COMMUNICATIONS" filed on Nov. 6, 2014 by HUAN-YU SU and co-pending U.S. patent application Ser. No. 14/629,864 entitled "IMPROVED NOISE SUPPRESSOR" filed on Feb. 24, 2015 by HUAN-YU SU. The above referenced pending patent applications are incorporated herein by reference for all purposes, as if set forth in full.

FIELD OF THE INVENTION

The present invention is related to audio signal processing and more specifically to system and method and computer-program product for improving the audio quality of voice calls in a communication device.

SUMMARY OF THE INVENTION

The improved quality of voice communications over mobile telephone networks have contributed significantly to the growth of the wireless industry over the past two decades. Due to the mobile nature of the service, a user's quality of experience (QoE) can vary dramatically depending on many factors. Two such key factors include the wireless link quality and the background or ambient noise levels. It should be appreciated, that these factors are generally not within the user's control. In order to improve the user's QoE, the wireless industry continues to search for quality improvement solutions to address these key QoE factors.

In theory, ambient noise is always present in our daily lives and depending on the actual level, such noise can severely impact our voice communications over wireless networks. A high noise level reduces the signal to noise ratio (SNR) of a talker's speech. Studies from members of speech standard organizations, such as 3GPP and ITU-T, show that lower SNR speech results in lower speech coding performance ratings, or low MOS (mean opinion score). This has been found to be true for all LPC (linear predictive coding) based speech coding standards that are used in wireless industry today.

Another problem with high level ambient noise is that it prevents the proper operation of certain bandwidth saving techniques, such as voice activity detection (VAD) and discontinuous transmission (DTX). These techniques operate by detecting periods of "silence" or background noise.

The failure of such techniques due to high background noise levels result in the unnecessary bandwidth consumption and waste.

Since the standardization of EVRC (enhanced variable rate codec, IS-127) in 1997, the wireless industry had embraced speech enhancement techniques that operate to cancel or reduce background noise. Traditional noise suppression techniques are typically based on the manipulation of speech signals in the spectrum domain, including techniques such as spectrum subtraction and the like. The problem with such prior-art techniques is that they all require the speech signals to be converted from the time domain to the spectrum domain and back again. For example, speech signals in the time domain are converted to the spectrum or frequency domain using Discrete Fourier transform or Fast Fourier transform (DFT/FFT) techniques. The signals are then manipulated in the spectrum domain using techniques such as spectrum subtraction and the like. Finally, the signals are converted back into the time domain using reverse DFT/FFT techniques.

One problem with such conventional methods of noise reduction is that they require large amounts of computational complexity. In addition, such methods typically introduce unwanted delay that worsens the mouth-to-ear latency.

Another problem with such conventional methods of spectrum domain manipulation is that unwanted spectrum distortion can be accidently introduced, making the noise reduced speech sound mechanical or 'robotic', which of course degrades the user perceived QoE in a different and unintentional way.

Due to the poor performance of traditional noise suppression techniques, another trend in the wireless industry is to use two or more microphones to maintain reasonably acceptable noise suppression. While in theory, multi-microphone techniques (and therefore multi-source speech signals) allow for better noise suppression, these technique carry with it significant cost and complexity increases that result in longer latency. In addition, such techniques still produce spectrally distorted voice quality.

In addition, at the receiving end of a communications system, the reconstructed (or down-link direction) speech signals are equivalent to a single source speech and as such, multi-source based noise suppression techniques are not applicable. Thus, there has been no attempt by the wireless industry to support noise suppression at the receiving end, or down-link direction, even though such an improvement will greatly enhance the user's perceived voice quality, especially when connected to another mobile device that does not support up-link noise suppression, such as older 2G/3G feature phones.

Accordingly, the present invention overcomes the deficiencies of prior-art systems and methods by providing a very low complexity and improved noise suppression system and method that can be used with low-cost single microphone systems in the up-link or down-link directions.

In addition, the present invention provides an improved noise suppression system and method that operates entirely in the time domain. Thus, the single gain based noise suppression technique of the present invention is extremely simple in terms of computational complexity, has zero additional latency, and is suitable for both up-link (Tx) and down-link (Rx) noise suppression techniques.

DETAILED DESCRIPTION

The present invention may be described herein in terms of functional block components and various processing steps. It should be appreciated that such functional blocks may be realized by any number of hardware components or software elements configured to perform the specified functions. For example, the present invention may employ various integrated circuit components, e.g., memory elements, digital signal processing elements, logic elements, look-up tables, and the like, which may carry out a variety of functions under the control of one or more microprocessors or other control devices. In addition, those skilled in the art will appreciate that the present invention may be practiced in conjunction with any number of data and voice transmission protocols, and that the system described herein is merely one exemplary application for the invention.

It should be appreciated that the particular implementations shown and described herein are illustrative of the invention and its best mode and are not intended to otherwise limit the scope of the present invention in any way. Indeed, for the sake of brevity, conventional techniques for signal processing, data transmission, signaling, packet-based transmission, network control, and other functional aspects of the systems (and components of the individual operating components of the systems) may not be described in detail herein, but are readily known by skilled practitioners in the relevant arts. Furthermore, the connecting lines shown in the various figures contained herein are intended to represent exemplary functional relationships and/or physical couplings between the various elements. It should be noted that many alternative or additional functional relationships or physical connections may be present in a practical communication system. It should be noted that the present invention is described in terms of a typical mobile phone system. However, the present invention can be used with any type of communication device including non-mobile phone systems, laptop computers, tablets, game systems, desktop computers, personal digital infotainment devices and the like. Indeed, the present invention can be used with any system that supports digital voice communications. Therefore, the use of cellular mobile phones as example implementations should not be construed to limit the scope and breadth of the present invention.

Figure 1:
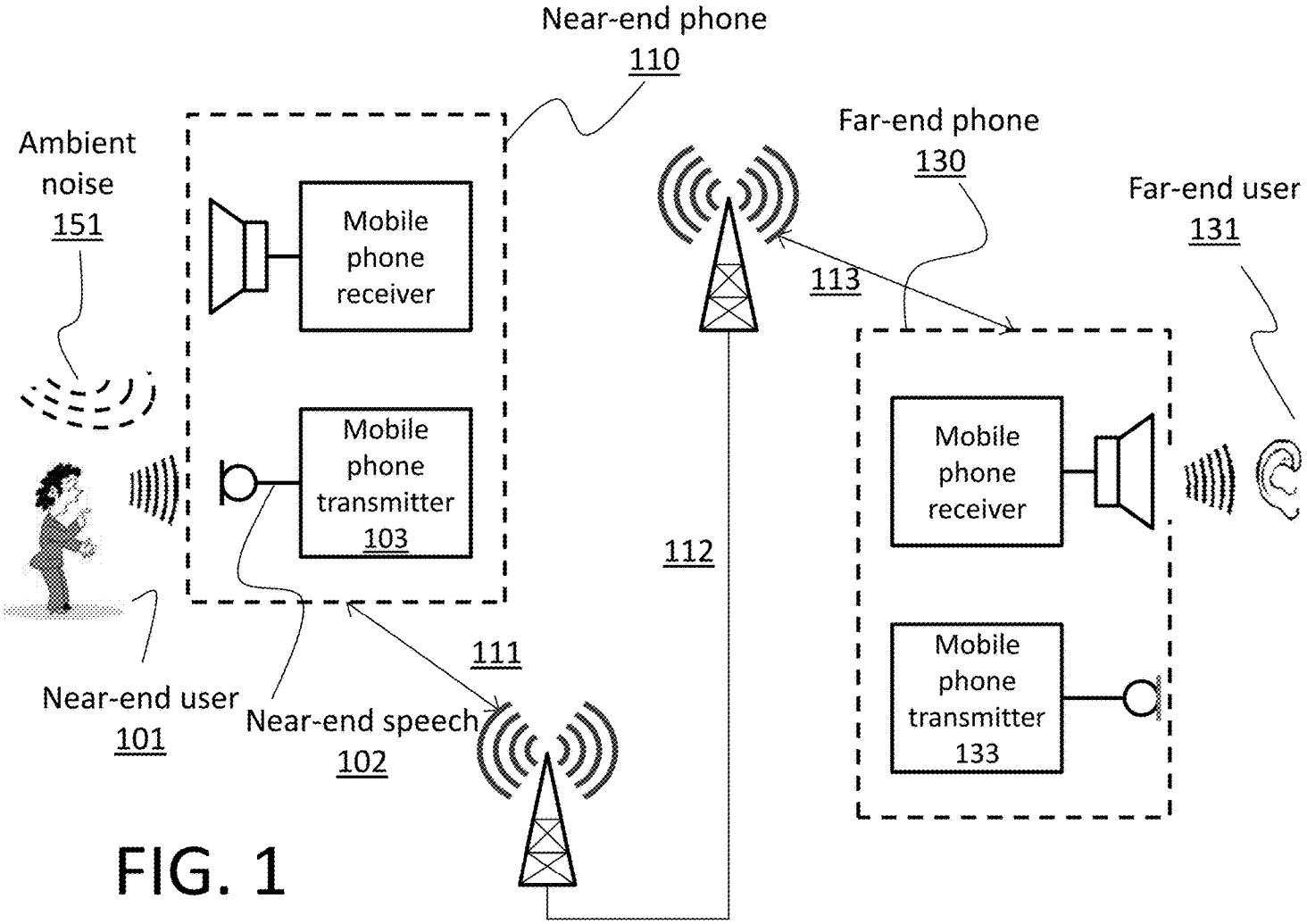
FIG. 1 is an exemplary schematic block diagram representation of a mobile phone communication system in which various aspects of the present invention may be implemented.

FIG. 1 illustrates a typical mobile phone system where two mobile phones, 110 and 130, are coupled together via certain wireless and wireline connectivity represented by the elements 111, 112 and 113. When the near-end talker 101 speaks into the microphone, the speech signal, together with the ambient noise 151, is picked up by the near-end microphone, which produces a near-end speech signal 102. The near-end speech signal 102 is received by the near-end mobile phone transmitter 103, which applies certain compression schemes before transmitting the compressed (or coded) speech signal to the far-end mobile phone 110 via the wireless/wireline connectivity, according to whatever wireless standards the mobile phones and the wireless access/transport systems support. Once received by the far-end mobile phone 130, the compressed speech is converted back to its linear form referred to as reconstructed near-end speech (or simply, near-end speech) before being played back through a loudspeaker or earphone to the far-end user 131.

Figure 2:
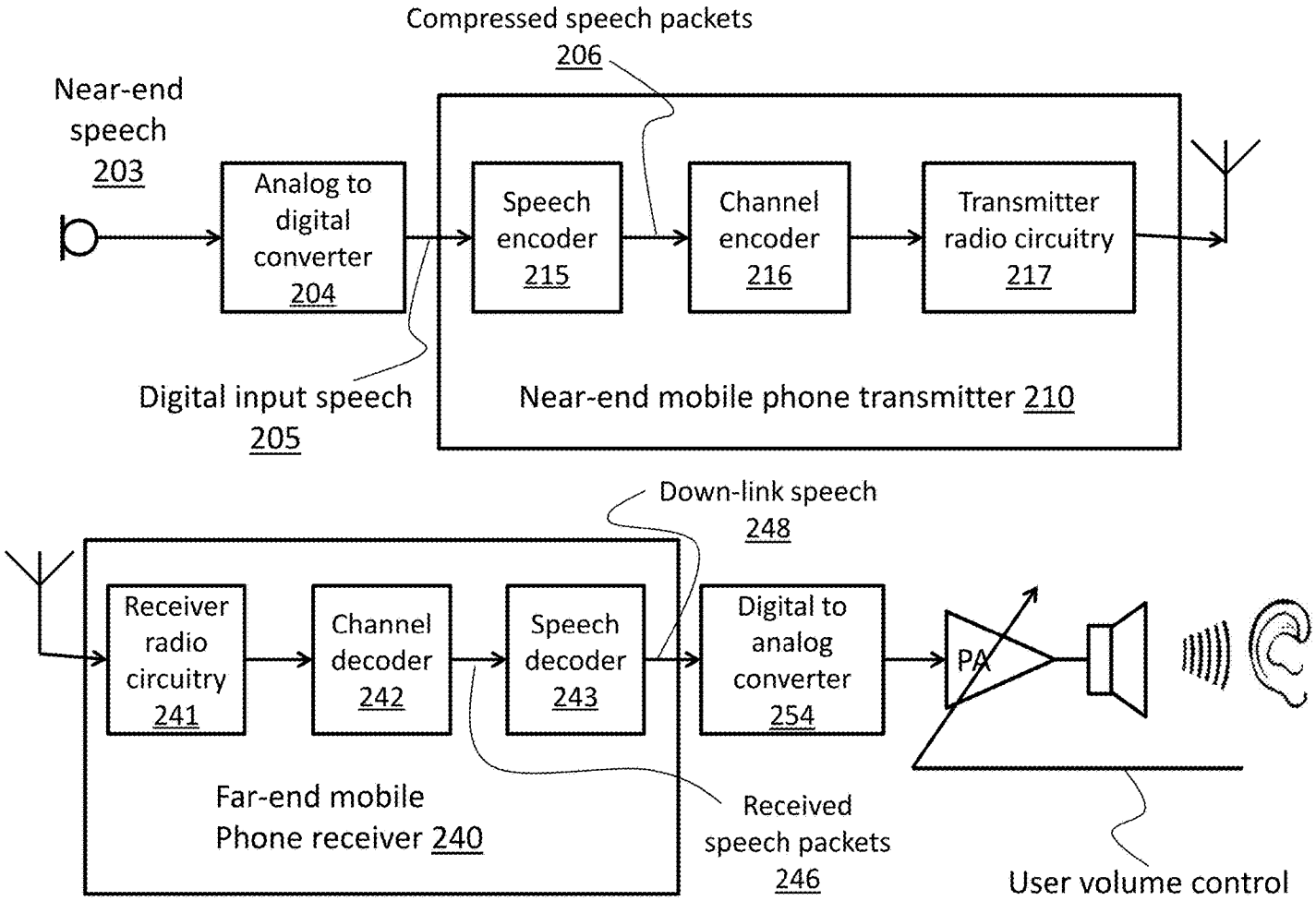
FIG. 2 highlights in more detail, exemplary flowcharts of a speech transmitter and receiver of a mobile phone communication system in accordance with one embodiment of the present invention.

FIG. 2 is a flow diagram that shows details the relevant processing units inside the near-end mobile phone transmitter and the far-end mobile phone receiver in accordance with one example embodiment of the present invention. The near-end speech 203 is received by an analog to digital convertor 204, which produces a digital form 205 of the near-end speech. The digital speech signal 205 is fed into the near-end mobile phone transmitter 210. A typical near-end mobile phone transmitter will now be described in accordance with one example embodiment of the present invention. First, the digital input speech 205 is compressed by the speech encoder 215 in accordance with whatever wireless speech coding standard is being implemented. Next, the compressed speech packets 206 go through a channel encoder 216 to prepare the packets 206 for radio transmission. The channel encoder is coupled with the transmitter radio circuitry 217 and is then transmitted over the near-end phone's antenna.

On the far-end phone, the reverse processing takes place. The radio signal containing the compressed speech is received by the far-end phone's antenna in the far-end mobile phone receiver 240. Next, the signal is processed by the receiver radio circuitry 241, followed by the channel decoder 242 to obtain the received compressed speech, referred to as speech packets or frames 246. Depending on the speech coding scheme used, one compressed speech packet can typically represent 5-30 ms worth of a speech signal. After the speech decoder 243, the reconstructed speech (or down-link speech) 248 is output to the digital to analog convertor 254.

Due to the never ending evolution of wireless access technology, it is worth mentioning that the combination of the channel encoder 216 and transmitter radio circuitry 217, as well as the reverse processing of the receiver radio circuitry 241 and channel decoder 242, can be seen as wireless modem (modulator-demodulator). Newer standards in use today, including LTE, WiMax and WiFi, and others, comprise wireless modems in different configurations than as described above and in FIG. 2. The use of the example wireless modems are shown for simplicity sake and are examples of one embodiment of the present invention. As such, the use of such examples should not be construed to limit the scope and breadth of the present invention.

Figure 3:
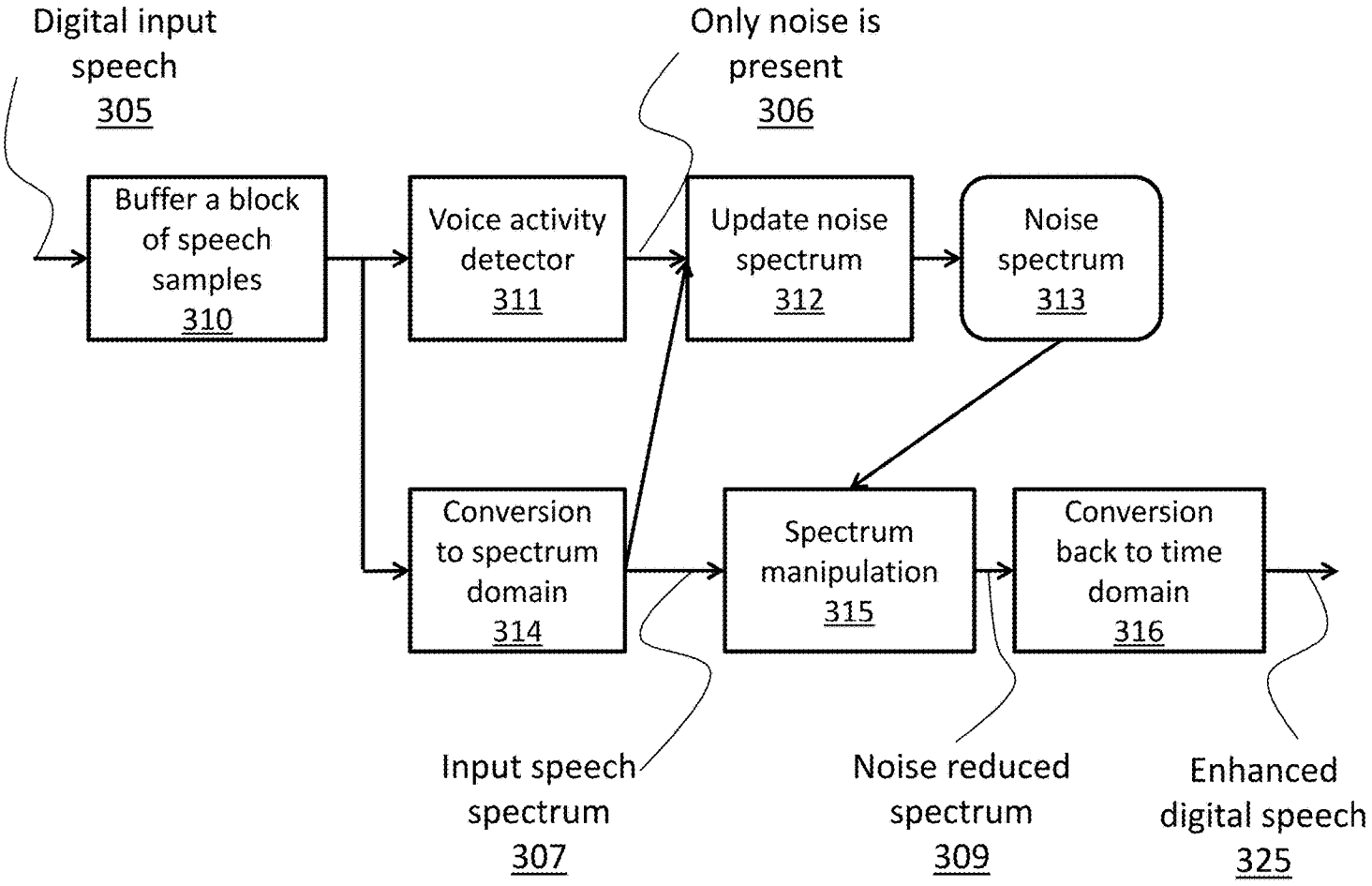
FIG. 3 illustrates a typical traditional noise suppressor based on spectrum manipulation/subtraction.

FIG. 3 illustrates a typical traditional noise suppressor based on spectrum manipulation/subtraction. Traditional noise suppression techniques are almost all based on spectrum manipulation known as spectrum subtraction. The principle behind such techniques is that, while speech and noise are only truly additive in the time domain, when the noise level is much lower than that of the speech signal, the cross-term in the spectrum domain is negligible, therefore speech and noise can also be approximated to be additive in the spectrum domain. It is further assumed that, while changing over time, noise is quasi-stationary. That is, it is assumed that noise is not changing or is very slowly changing over a certain short periods of time. Using such assumptions, one can monitor the noise spectrum during time periods where there is no near-end talker's speech, (i.e., times when only noise is present). At this point, the noise spectrum is subtracted from the input spectrum, with or without the near-end talker's speech. This principle is illustrated in greater detail with reference to FIG. 3.

Referring now to FIG. 3, digital input speech 305 is input into a speech sample buffer 310. The speech samples, which contain speech and noise, are then converted into the spectrum or frequency domain 314. At the same time a VAD or voice activity detector 311, is used to detect time periods when no speech is present (i.e. only noise is present 306). The noise spectrum update module 312 takes spectrum from noise only periods and generates an updated noise spectrum 313, whenever it is possible. In parallel, the noise spectrum 313 is subtracted from the input speech spectrum 307 by the spectrum manipulation module 315 to generate a noise reduced spectrum 309. Finally, enhanced digital speech 325 is obtained by converting the noise reduced spectrum back to the time domain by the module 316.

While such prior-art techniques using spectrum manipulation, as discussed above, can effectively remove the noise from the speech signal to produce an enhanced speech output, it has some well-known drawbacks. First, quasi-stationary noises do exist, but the large majority of real-life application conditions include noises that are rapidly changing. This fact results in an inevitable mismatch between the estimated noise spectrum and the actual noise spectrum. In addition, even when real-life quasi-stationary noises are present, there are inevitable signal variations at the millisecond level, resulting in local spectrum mismatch, which produces the well known "music tone" effect in the reproduced speech. Finally, when noise spectrum estimates accidentally include non-noise periods, i.e., when the voice-activity-detector misclassifies speech segments as noise, which corrupts the noise spectrum estimate 312, the spectrum manipulation 315 creates audible spectrum distortion in the output speech 325. With such unavoidable drawbacks, even though the noise might be largely reduced by such noise suppressors, the output speech 325 often sounds mechanical or has obvious artifacts that are objectionable to the human auditory system.

It should also be noted that multiple microphones are sometimes used to increase the detection accuracy and/or improve the noise spectrum estimate. From a signal processing point of view, having more reference data helps the detection accuracy. However, when the noise signal behavior inherently prevents the accurate detection of the true noise spectrum, such as fast changing noise having local spectrum variations, such traditional solutions still result in degraded output speech.

In addition, the noise suppressor in the prior-art models require a block of speech samples to effectuate the conversion to the spectrum domain. This, as shown in FIG. 3, is accomplished by means of a buffer 310, at the front-end of the noise suppressor. Unfortunately, such buffering may create non-negligible delays causing additional quality problems. For example, at the reconversion back to the time domain, because of the spectrum manipulation performed on the signal, the transition from the previous block and the present block could be large enough to require a well known "overlap-and-add" period between approximately 10-40 speech samples.

Figure 4A:
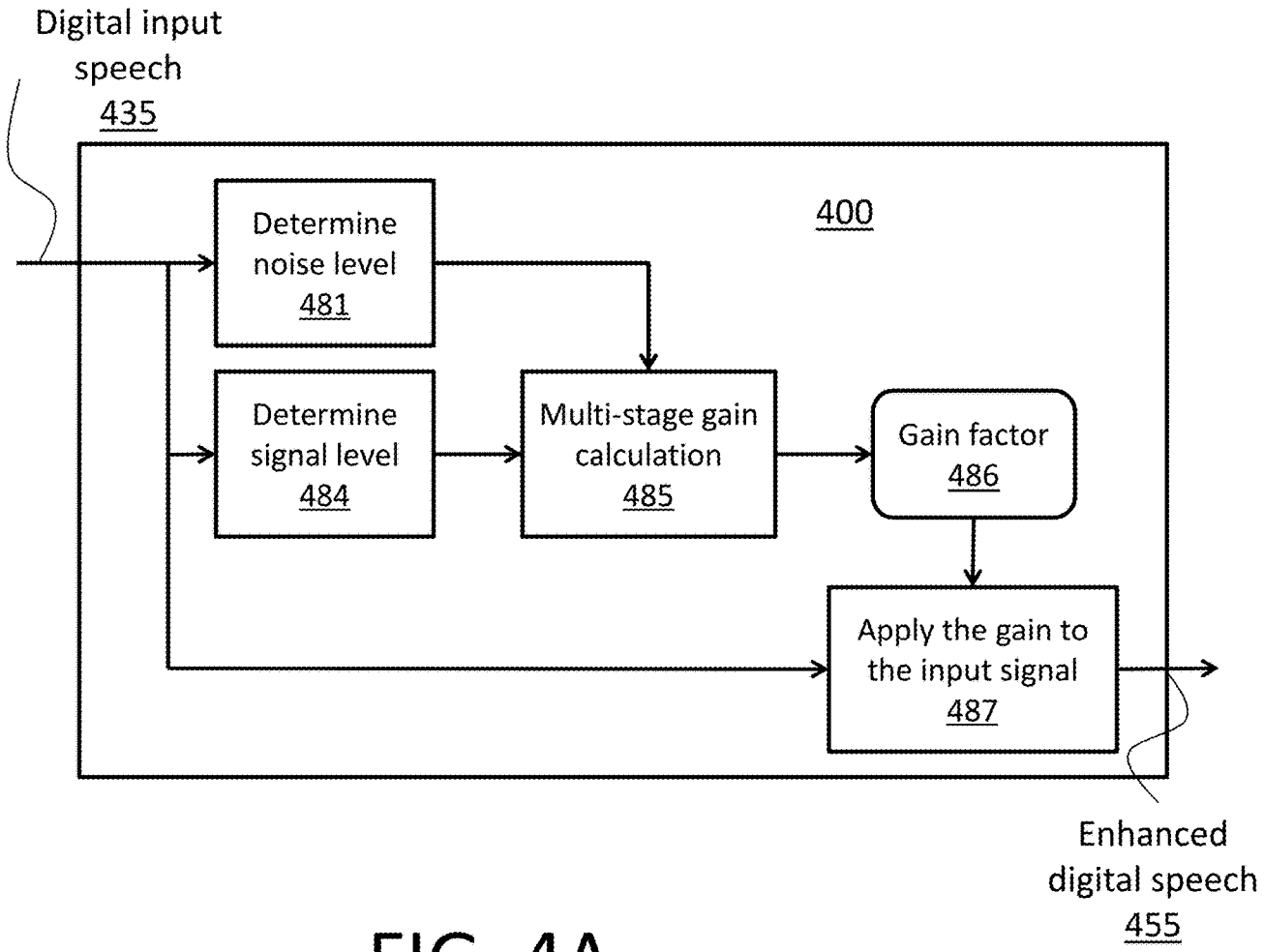
FIG. 4A depicts an exemplary implementation of the present invention.

FIG. 4A depicts an exemplary implementation of a noise suppressor 400 in accordance with one embodiment of the present invention. The noise suppressor 400 operates entirely in the time domain in order to avoid the problems found in the prior-art systems using the spectrum domain, specifically problems including but not limited to poor quality, unwanted latency, high computational complexity and equipment costs.

The digital input speech 435 is evaluated to determine the noise level 481. Techniques such as voice activity detection and the like are used to maintain a high accuracy of the noise level determination. However, mistakes are tolerated by the proposed technique quite well, as compared to prior-art methods. Due to its nature, noises are inherently time varying. Not only will its nature change from time to time, (such as the case where a car noise, for example, is combined with a nearby talker's low level voice), but also its level will change, (such as the case where a truck suddenly approaches and passes by). Thus, an absolute and accurate detection of noise vs. speech is not practically possible. To overcome this inherent problem, the present invention uses a weighted mean factor as described below, with reference to FIG. 4B, as the detected noise level indicator.

In parallel, the digital input speech signal 435 is also used to determine the actual signal level 484. It should be noted that when there is no active speech from the near-end talker, the signal level 484 and the noise level 481 are very close or identical. A large difference between these two levels indicate that the talker's active voice is present.

After the signal level determinations 481 and 484, those parameters are used by a multi-stage gain calculation module 485 to produce a signal gain factor 486. The output noise reduced signal 455 is the gain 486 shaped original speech signal 435.

Conventional voice activity detectors provide an indication on whether active speech is present. These conventional VAD devices work well with pure noise periods, but not so well with mixed speech and noise periods. While pure noise periods do exist, speech mixed with noise is also a very common phenomenon. Therefore, a simple binary decision mechanism, cannot provide an accurate indication for the purposes of the present invention.

Therefore, instead of using a typical VAD, the present invention provides a novel approach where the detected noise level and actual signal level are used as confidence parameters to calculate a gain factor. This concept is depicted in FIG. 4B where the gain factor is shown as G at 472.

Figure 4B:
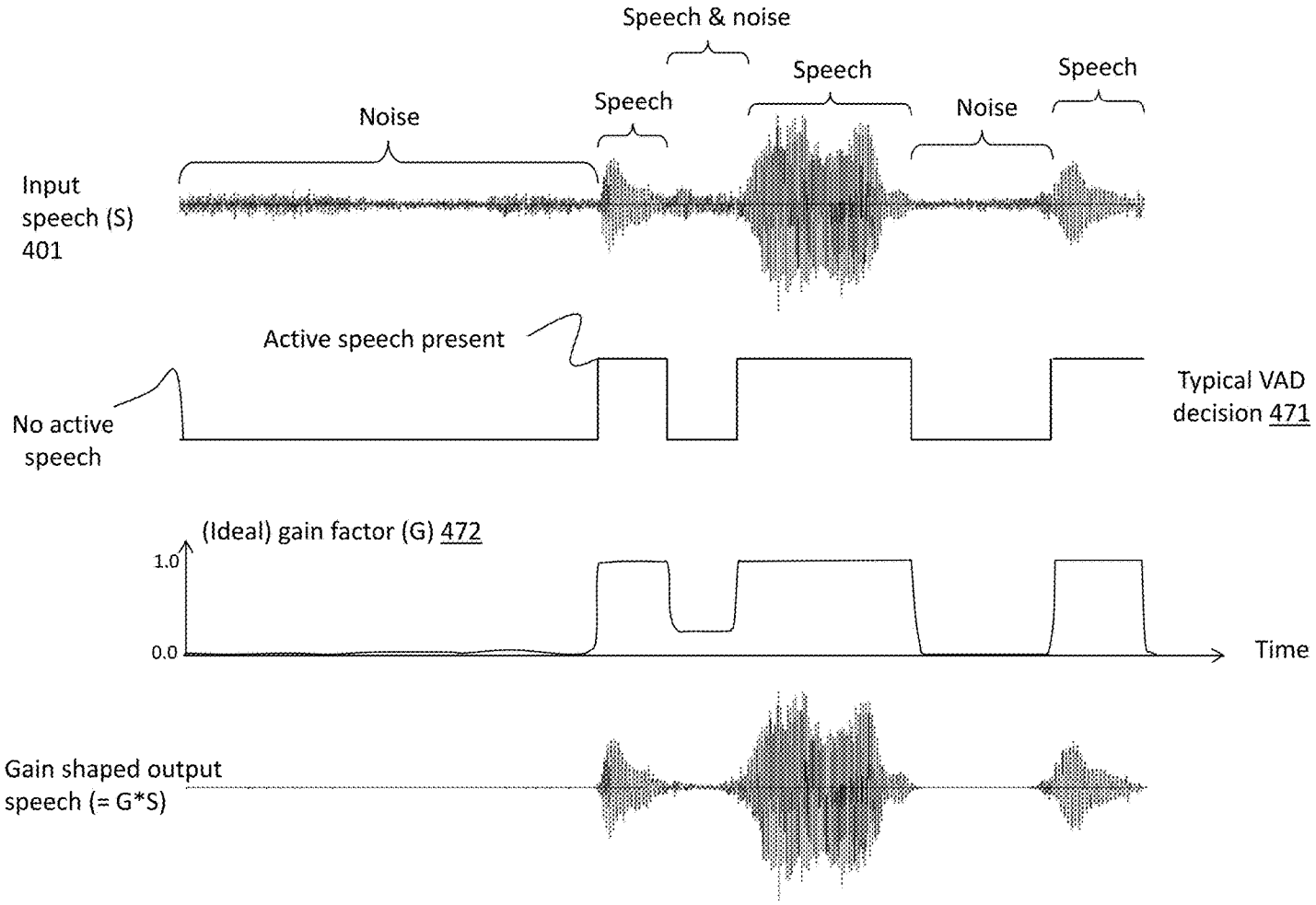
FIG. 4B depicts an exemplary implementation of a gain factor and gain shaped output in accordance with one embedment of the present invention

The input speech (S) 401 is shown at the top of FIG. 4B. As shown, the speech signal 401 comprises periods of pure Noise, pure Speech and mixtures of speech and noise. The second waveform 471 shows the output of a conventional VAD, for the input speech signal 401. In particular, the VAD output is either 0 or 1, depending on whether the level of the input speech signal 401 is below or above a predetermined threshold. As can be seen, the simple VAD in this example, goes to 0 during the Speech & Noise period because the level of the combined Speech & Noise is below the predetermined threshold of the VAD.

In accordance with the present invention, an Ideal gain factor (G) 472 is calculated. This is accomplished by comparing the actual signal level with the detected noise level. When the signal level is close to the detected noise level, confidence is high that current signal is noise-only. Therefore the gain factor remains close to 0 under these conditions. However, when the current signal level is larger than that of the detected noise level, then the confidence is low that the current signal is noise-only, therefore the gain factor will be increased towards 1.0. This gain factor adaptation is performed on a sample by sample basis. An ideal gain factor should be close to 0.0 for pure noise, close to 1.0 when active speech is present, and take a value between 0.0 and 1.0 depending on the confidence about how much speech is present.

For normal applications, the gain factor will be close to 1.0 for signal periods where the near-end talker's speech is present. The gain factor will be very small, or even close to 0.0 for signal periods where there is only noise. For other segments, the gain factor would be between 0.0 and 1.0. For applications when AGC (automatic gain control) or ALC (automatic level control) is implemented in conjunction with the present invention, the gain factor can be larger than 1.0.

The present invention can be implemented as a sample-in/sample-out module, resulting in zero latency increase. Also the complexity is extremely small, since only a few multiply and addition operations are required per each speech sample.

Figure 5:
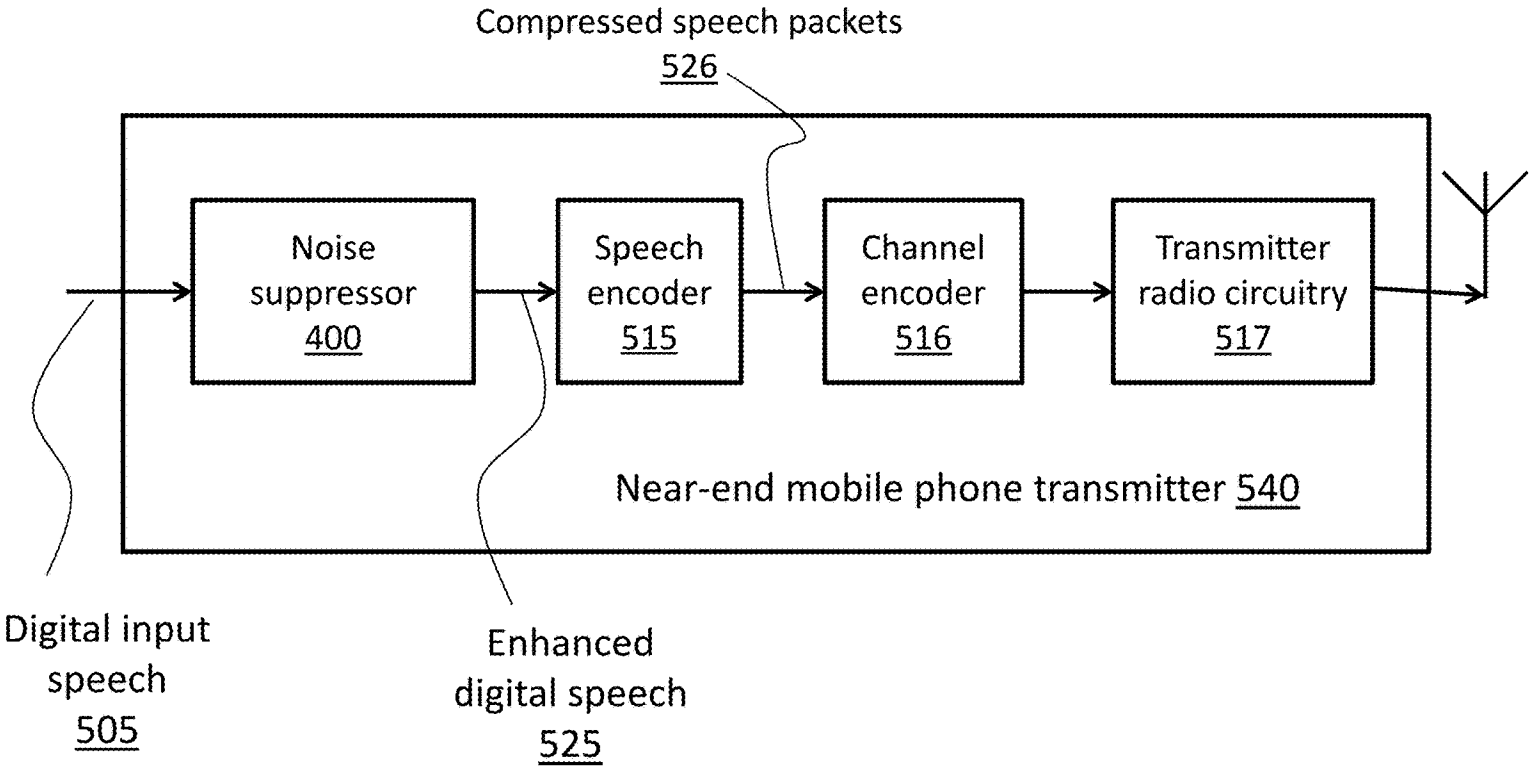
FIG. 5 illustrates the use of an exemplary noise suppressor module in the speech transmitter in accordance with one embodiment of the present invention.

FIG. 5 illustrates one embodiment of the present invention, and in particular, illustrates the case when a noise suppressor 400 is used in the near-end phone's transmitting path. The digital input speech signal(s) 305 from one or a multi-microphone system is fed into the noise suppressor 400 to produce an enhanced digital speech 525.

The enhanced digital speech signal 525 is next fed into the speech encoder 515. The enhanced digital speech 525 is compressed by the speech encoder 515 in accordance with whatever wireless speech coding standard is being implemented. Next, the enhanced compressed speech packets 526 go through a channel encoder 516 to prepare the packets for radio transmission. The channel encoder is coupled with the transmitter radio circuitry 517 and is then transmitted over the near-end phone's antenna.

Figure 6:
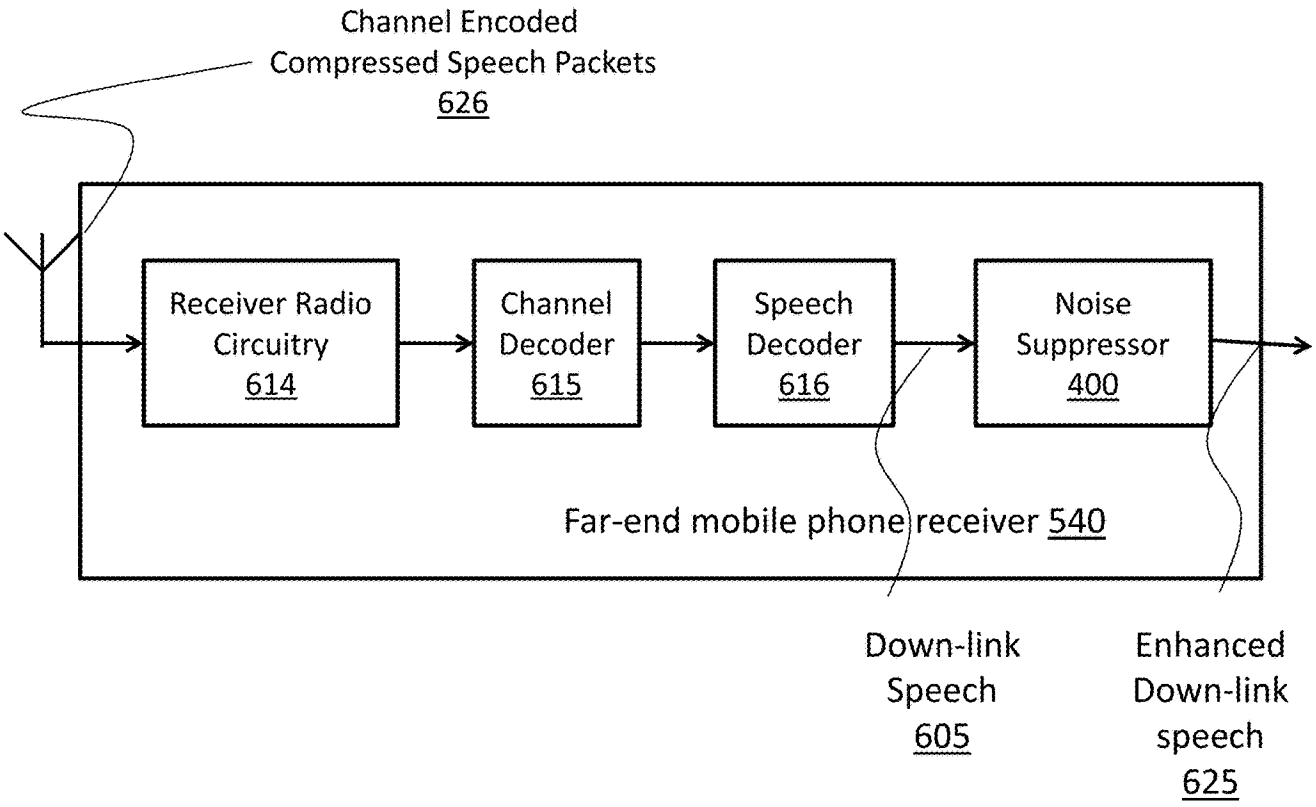
FIG. 6 illustrates the use of an exemplary noise suppressor module in the speech receiver in accordance with one embodiment of the present invention.

FIG. 6 illustrates another embodiment of the present invention, and in particular, illustrates the case when a noise suppressor 400 is used in the far-end phone's receiving path. The channel-encoded compressed speech packets are received by radio circuitry 614 via the far-end phones radio antenna. The speech packets are next decoded and decompressed via the channel decoder 615 and the speech decoder 616, respectively. Next, the down-link digital speech signals are fed into a noise suppressor 400 in accordance with the principles of the present invention, to produce the noise-reduced enhanced down-link digital speech. Finally, the enhanced speech is set to a digital to analog converter for amplification and play back to the far-end user.

Figure 7:
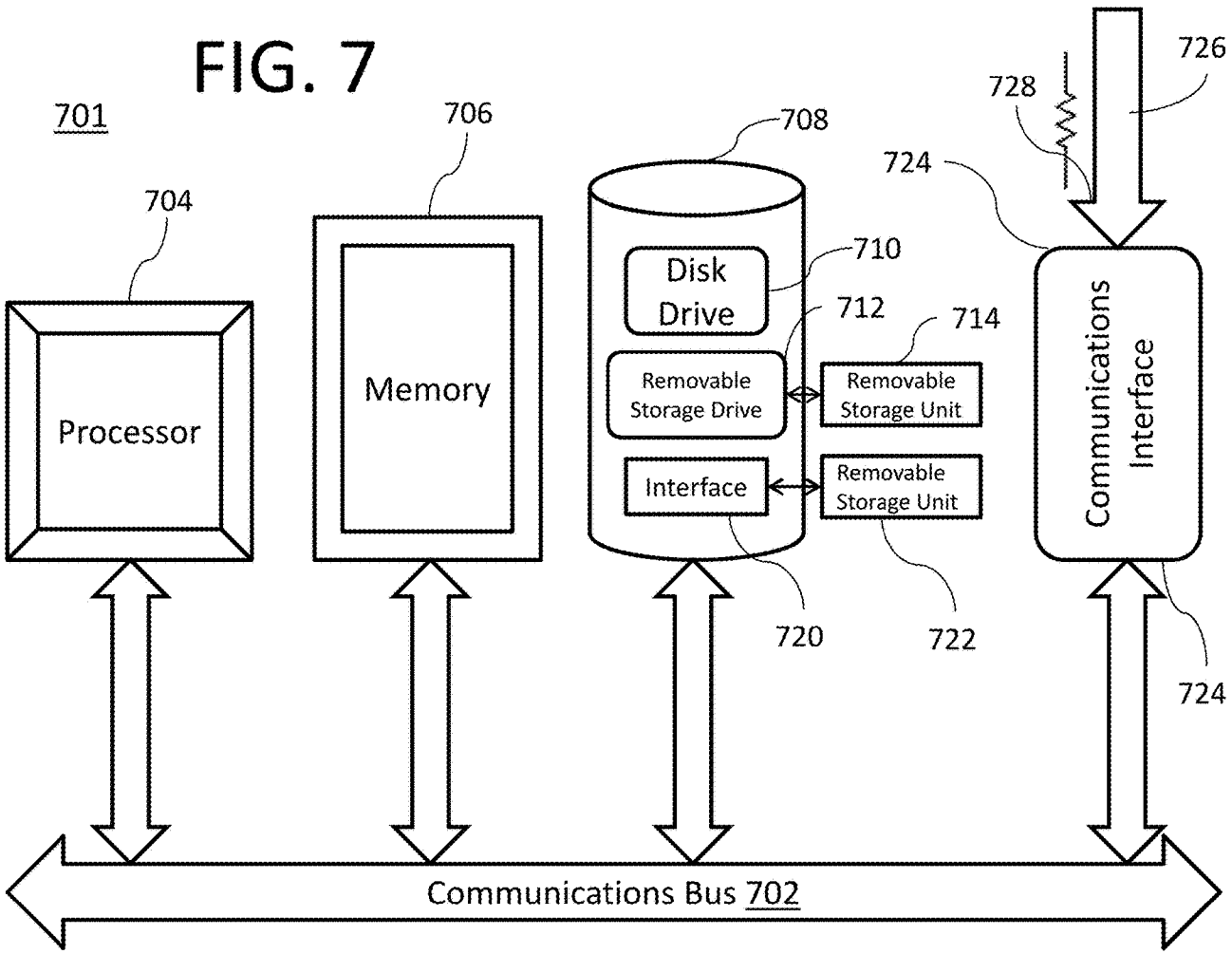
FIG. 7 illustrates a typical computer system capable of implementing an example embodiment of the present invention.

The present invention may be implemented using hardware, software or a combination thereof and may be implemented in a computer system or other processing system. Computers and other processing systems come in many forms, including wireless handsets, portable music players, infotainment devices, tablets, laptop computers, desktop computers and the like. In fact, in one embodiment, the invention is directed toward a computer system capable of carrying out the functionality described herein. An example computer system 701 is shown in FIG. 7. The computer system 701 includes one or more processors, such as processor 704. The processor 704 is connected to a communications bus 702. Various software embodiments are described in terms of this example computer system. After reading this description, it will become apparent to a person skilled in the relevant art how to implement the invention using other computer systems and/or computer architectures.

Computer system 701 also includes a main memory 706, preferably random access memory (RAM), and can also include a secondary memory 708. The secondary memory 708 can include, for example, a hard disk drive 710 and/or a removable storage drive 712, representing a magnetic disc or tape drive, an optical disk drive, etc. The removable storage drive 712 reads from and/or writes to a removable storage unit 714 in a well-known manner. Removable storage unit 714, represent magnetic or optical media, such as disks or tapes, etc., which is read by and written to by removable storage drive 712. As will be appreciated, the removable storage unit 714 includes a computer usable storage medium having stored therein computer software and/or data.

In alternative embodiments, secondary memory 708 may include other similar means for allowing computer programs or other instructions to be loaded into computer system 701. Such means can include, for example, a removable storage unit 722 and an interface 720. Examples of such can include a USB flash disc and interface, a program cartridge and cartridge interface (such as that found in video game devices), other types of removable memory chips and associated socket, such as SD memory and the like, and other removable storage units 722 and interfaces 720 which allow software and data to be transferred from the removable storage unit 722 to computer system 701.

Computer system 701 can also include a communications interface 724. Communications interface 724 allows software and data to be transferred between computer system 701 and external devices. Examples of communications interface 724 can include a modem, a network interface (such as an Ethernet card), a communications port, a PCMCIA slot and card, etc. Software and data transferred via communications interface 724 are in the form of signals which can be electronic, electromagnetic, optical or other signals capable of being received by communications interface 724. These signals 726 are provided to communications interface via a channel 728. This channel 728 carries signals 726 and can be implemented using wire or cable, fiber optics, a phone line, a cellular phone link, an RF link, such as WiFi or cellular, and other communications channels.

In this document, the terms "computer program medium" and "computer usable medium" are used to generally refer to media such as removable storage device 712, a hard disk installed in hard disk drive 710, and signals 726. These computer program products are means for providing software or code to computer system 701.

Computer programs (also called computer control logic or code) are stored in main memory and/or secondary memory 708. Computer programs can also be received via communications interface 724. Such computer programs, when executed, enable the computer system 701 to perform the features of the present invention as discussed herein. In particular, the computer programs, when executed, enable the processor 704 to perform the features of the present invention. Accordingly, such computer programs represent controllers of the computer system 701.

In an embodiment where the invention is implemented using software, the software may be stored in a computer program product and loaded into computer system 701 using removable storage drive 712, hard drive 710 or communications interface 724. The control logic (software), when executed by the processor 704, causes the processor 704 to perform the functions of the invention as described herein.

In another embodiment, the invention is implemented primarily in hardware using, for example, hardware components such as application specific integrated circuits (ASICs). Implementation of the hardware state machine so as to perform the functions described herein will be apparent to persons skilled in the relevant art(s).

In yet another embodiment, the invention is implemented using a combination of both hardware and software.

While various embodiments of the present invention have been described above, it should be understood that they have been presented by way of example only, and not limitation. Thus, the breadth and scope of the present invention should not be limited by any of the above-described exemplary embodiments, but should be defined only in accordance with the following claims and their equivalents.

The invention claimed is:

1. A method for improving the quality of a voice call over a communication link using a communication device, the communication device having a down-link receiver for receiving a far-end voice signal and a far-end noise signal, the method comprising the steps of:

monitoring the noise signal to determine a noise level of a sample of the noise signal in a time domain;

monitoring the voice signal to determine a signal level of said sample of the voice signal in said time domain;

comparing said noise level to said signal level in said time domain to calculate a difference;

assigning a noise confidence parameter, wherein said noise confidence parameter is low when said difference is high and said noise confidence parameter is high when said difference is low;

calculating a gain factor, wherein said gain factor is close to 0 when said noise confidence parameter is above a first predetermined threshold and said gain factor is close to 1 when said noise confidence parameter is below a second predetermined threshold and said gain factor increases between 0 and 1 as said noise confidence parameter decreases between said first and second predetermined thresholds; and applying said gain factor to said voice signal to produce an enhanced speech signal; and outputting said enhanced speech signal.

2. A non-transitory computer program product comprising a non-transitory computer useable medium having computer program logic stored therein, said computer program logic for enabling a computer processing device to improve the quality of a voice call over a communication link using a communication device, the communication device having a down-link receiver for receiving a far-end voice signal and a far-end noise signal, the computer program product comprising:

code for monitoring the noise signal to determine a noise level of a sample of the noise signal in a time domain;

code for monitoring the voice signal to determine a signal level of said sample of the voice signal in said time domain;

code for comparing said noise level to said signal level in said time domain to calculate a difference;

code for assigning a noise confidence parameter, wherein said noise confidence parameter is low when said difference is high and said noise confidence parameter is high when said difference is low;

code for calculating a gain factor, wherein said gain factor is close to 0 when said noise confidence parameter is above a first predetermined threshold and said gain factor is close to 1 when said noise confidence parameter is below a second predetermined threshold and said gain factor increases between 0 and 1 as said noise confidence parameter decreases between said first and second predetermined thresholds; and code for applying said gain factor to said voice signal to produce an enhanced speech signal; and code for outputting said enhanced speech signal.

3. A noise suppressor for improving the audio quality of a voice call in a in a communication device comprising:

a down-link receiver capable of receiving a noise signal and a voice signal;

a noise-level module for determining a noise level of a sample of said noise signal in a time domain;

a voice-level module for determining a voice level of said sample of said voice signal in said time domain;

a comparator for comparing said noise level to said signal level to calculate a difference;

a confidence parameter module for assigning a noise confidence parameter based on said comparator, wherein said noise confidence parameter is low when said difference is high and said noise confidence parameter is high when said difference is low;

a gain-factor calculator for calculating a gain factor, wherein said gain factor is close to 0 when said noise confidence parameter is above a first predetermined threshold and said gain factor is close to 1 when said noise confidence parameter is below a second predetermined threshold and said gain factor increases between 0 and 1 as said noise confidence parameter decreases between said first and second predetermined thresholds;

a multiplier for multiplying said gain factor with said voice signal to produce an enhanced speech signal; and an output device capable of outputting said enhanced speech signal for playback to a user.

* * * * *